US005576540A

United States Patent [19]

Jolliffe

[11] Patent Number: 5,576,540

[45] Date of Patent: Nov. 19, 1996

[54] MASS SPECTROMETER WITH RADIAL EJECTION

[75] Inventor: Charles L. Jolliffe, Kettleby, Canada

[73] Assignee: MDS Health Group Limited, Etobicoke, Canada

[21] Appl. No.: 514,369

[22] Filed: Aug. 11, 1995

[51] Int. Cl.[6] ..... H01J 49/42

[52] U.S. Cl. ..... 250/292; 250/282; 250/283

[58] Field of Search ..... 250/292, 293, 250/291, 290, 281, 282, 283

[56] References Cited

U.S. PATENT DOCUMENTS

| | | | |
|---|---|---|---|
| Re. 34,000 | 7/1992 | Syka et al. | 250/292 |
| 3,629,573 | 12/1971 | Carrico et al. | 250/292 |
| 3,925,662 | 12/1975 | Dawson | 250/292 |
| 4,540,884 | 9/1985 | Stafford et al. | 250/282 |
| 5,420,425 | 5/1995 | Bier et al. | 250/292 |

*Primary Examiner*—Jack I. Berman
*Assistant Examiner*—Kiet T. Nguyen
*Attorney, Agent, or Firm*—Bereskin & Parr

[57] ABSTRACT

A mass analyzer having a set of rods, e.g. quadrupole rods, into which ions are injected axially and are then contained by the combination of collision gas in the volume between the rods and end lenses which prevent the ions from leaving the volume between the rods. After the ions have been contained and manipulated, they are ejected radially through an opening or slot in one of the rods for detection. The configuration provides many of the advantages of a conventional ion trap, e.g. greater sensitivity, while avoiding a number of disadvantages of a conventional trap. If desired ions can be dissociated by applying an axial oscillating field, before being radially ejected.

5 Claims, 4 Drawing Sheets

MASS SPECTROMETER WITH RADIAL EJECTION

FIELD OF THE INVENTION

This invention relates to methods and apparatus for mass spectrometry. More particularly it relates to methods and apparatus for mass spectrometry in which a linear mass spectrometer is used in a non-conventional way, for ion trapping followed by ejection of ions for detection.

BACKGROUND OF THE INVENTION

Conventional mass spectrometers, such as linear quadrupole mass spectrometers, have been widely used for many years. Linear quadrupole mass spectrometers use four parallel spaced hyperbolic surfaces with appropriate voltages to establish a two-dimensional quadrupole field. A popular close approximation to the hyperbolic surfaces uses four parallel spaced round rods. Such mass spectrometers act as a filter, transmitting ions in a selected range of mass to charge ratios when the ions are injected into one end of the elongated space between the rods. Such mass spectrometers have performed well. However their full scan sensitivity (defined as number of ions detected/given amount of sample injected) is low, since during scanning they transmit ions of only one mass at a time, and during such transmission, ions of all other masses from the source are wasted.

Examples of linear mass spectrometers are those shown (for example) in U.S. Pat. Nos. 4,329,582; 5,248,875, and 4,963,736.

Partly because of the low sensitivity (as defined above) of conventional linear mass spectrometers, mass spectrometers known as ion traps have become more popular. Ion traps utilize a ring electrode and a pair of end caps, all of which have hyperbolic surfaces, with appropriate voltages to establish a three-dimensional trapping field which traps ions within a mass range of interest in the relatively small volume between the ring electrode and end caps. Various potentials may then be applied to eject ions (usually sequentially) for analysis. If the time needed to manipulate the ions in the ion trap and to scan them out of the trap is small in relation to the time needed to fill the trap, then fewer ions are wasted by the trap and hence the efficiency of the trap can be higher than that of a linear mass spectrometer.

Examples of patents which show ion traps are U.S. Pat. No. 4,540,884, U.S. Pat. No. Re. 34,000, and U.S. Pat. No. 5,381,007.

While ion traps tend to be more sensitive than linear mass spectrometers, ion traps suffer from several disadvantages. One disadvantage is that because the trapping volume of a conventional ion trap is relatively small, the number of ions which it can accept before space charge effects in the trap volume create a serious problem is quite limited (typically an ion trap can accept a maximum of only about one million ions). Since it can accept so few ions, many ions from the sample may again be wasted, resulting in relatively low sensitivity.

In addition, because space charge effects can create a non-linear response, the dynamic range of a trap (i.e. the range over which the response remains linear with respect to the injected sample) is limited. Further, it is commonly necessary to conduct a pre-check before using the ion trap for analysis, to determine if there is a space charge problem.

Another disadvantage of a conventional ion trap is that more than 90% of externally created ions injected into the trap are lost, principally due to the small trap volume (many of the ions entering the trap impact a neutralizing surface and are lost). Typically only 3% to 10% of the ions entering the trap are in fact trapped.

It would therefore be desirable to create an improved mass spectrometer which has at least some of the advantages of an ion trap, e.g. a shorter time to manipulate and scan out all the ions of interest, and yet which overcomes at least some of the disadvantages.

SUMMARY OF THE INVENTION

Accordingly, it is an object of the invention in one of its aspects to provide a linear mass spectrometer which has some of the advantages of a conventional ion trap, and in which some of the disadvantages are reduced. In one aspect the invention provides a mass analyzer comprising:

(a) a set of elongated rods defining an axially elongated volume between them, said volume having an axial dimension and having ends, and a radial dimension, (b) ion source means for injecting or forming ions in said volume, (c) potential means, including means for applying potentials to said rods, for establishing an electric field in and adjacent to said volume to contain ions in a selected mass range in said volume, (d) means for ejecting ions radially from said volume for detection, (e) and means for detecting at least some of the radially ejected ions.

In another aspect the invention provides a method of mass analyzing a sample comprising:

(a) defining a volume between a set of elongated rods, said volume having an elongated axial dimension and a radial dimension, (b) injecting into or forming ions of interest in said volume, (c) creating an electric field in and adjacent to said volume to contain ions in a mass range of interest in said volume, (d) dissociating ions trapped in said volume, (e) ejecting ions of interest radially from said volume for detection, (f) and detecting at least some of the ejected ions.

Further objects and advantages of the invention will appear from the following description, taken together with the accompanying drawings.

DETAILED DESCRIPTION OF PREFERRED EMBODIMENTS

Figure 1:
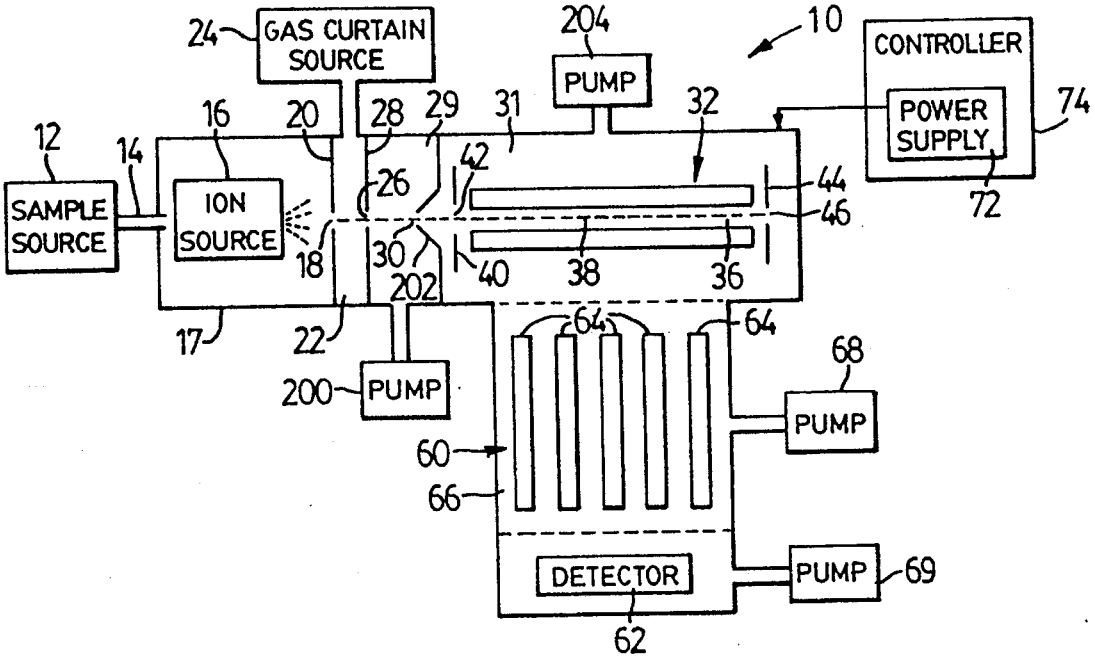
FIG. 1 is a diagrammatic view of a linear mass spectrometer according to the invention.

Reference is first made to FIG. 1, which shows a linear mass spectrometer 10 according to the invention. Mass spectrometer 10 includes a conventional sample source 12, which can be a liquid chromatograph, a gas chromatograph, or any other desired source of sample. From source 12, sample is conducted via tube 14 to an ion source 16 which ionizes the sample. Ion source 16 can be (depending on the type of sample) an electrospray or ion spray device, as shown in U.S. Pat. Nos. 4,935,624 and 4,861,988 respectively, or it can be a corona discharge needle (if the sample source is a gas chromatograph), or it can be a plasma, as shown in U.S. Pat. No. 4,501,965. Ion source 16 is located in a chamber 17.

From ion source 16, ions are directed through an aperture 18 in a plate 20, through a gas curtain chamber 22 supplied by gas curtain source 24 (as shown in U.S. Pat. No. 4,137,750), and then through an orifice 26 in orifice plate 28 and into a first stage vacuum chamber 29, pumped e.g. to 1 torr by pump 200. The curtain gas from source 24 is typically nitrogen, but since $N_2$ has a mass of 28 and can cause scattering of low mass ions, helium may alternatively be used. The ions then pass through an orifice 30 in a skimmer 202 and into a second stage vacuum chamber 31. Chamber 31 is pumped e.g. to 2 millitorr by pump 204.

Figure 2:
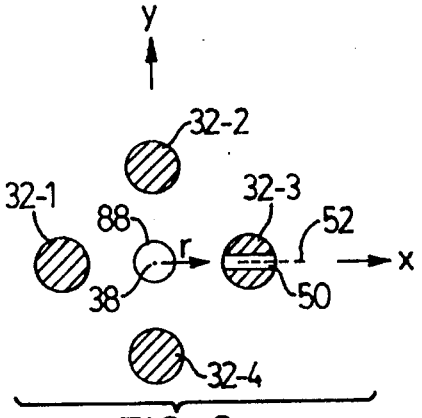
FIG. 2 is a cross-sectional view of the rod assembly of the FIG. 1 mass spectrometer.

Vacuum chamber 31 contains a set of quadrupole rods 32, consisting of four rods 32-1 to 32-4 inclusive (FIG. 2), extending parallel to each other and spaced apart to define an elongated interior volume 36. Volume 36 extends lengthwise along the longitudinal central axis 38 of the rod set 32 and has a radial dimension r (FIG. 2). Rods 32-1 and 32-3 will also be called the x rods, since they are on the x-axis, and rods 32-2 and 32-4 will be called the y rods since they are on the y-axis.

Entrance of ions from orifice 30 into one end of the interior volume 36 is controlled by an entrance lens 40, which in the embodiment shown can consist of a simple plate having a central orifice 42. Exit of ions from the other end of interior volume 36 is controlled by an exit lens 44, which again can consist of a simple plate having an orifice 46. (The orifice 46 is optional and need not be present, for reasons which will be explained.)

Figure 3:
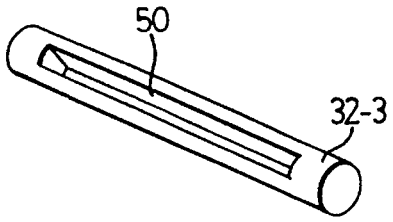
FIG. 3 is a perspective view of one of the rods of the rod assembly of FIG. 2.

One of the rods 32-3 includes a slot 50 therein (FIGS. 2 and 3) extending completely through the rod 32-3, from the radially innermost to the radially outermost surfaces of the rod. As best shown in FIG. 2, slot 50 has an axis 52 which coincides with a radius extending from axis 38 orthogonally to the rod 32-3.

As will be explained, ions of interest are trapped in the linear volume 36 and can then be ejected radially and sequentially through slot 50 for analysis. Therefore, outside slot 50 is located an "ion pipe" 60, which directs ejected ions to a detector 62. Ion pipe 60 consists of a set of parallel rods 64 to which RF potential only is applied (as will be explained), so that rods 64 function as an ion transmission device, directing the ions into detector 62 while permitting gas pumped from between rods 64 to escape. The rods 64 are mounted in a chamber 66 to which is connected a pump 68, which may pump chamber 66 e.g. to a pressure of 0.2 millitorr. A separate pump 69 may pump the chamber in which detector 62 is located to a lower pressure, e.g. $10^{-5}$ torr.

In use, curtain gas (typically nitrogen as mentioned) from gas curtain source 24 effuses gently forwardly through orifice 18 into chamber 17 to prevent contaminants and other gases from entering vacuum chambers 31, 66. Excess gas leaves chamber 17 via an outlet, not shown.

Ions from ion source 16 travel through orifices 18, 26 and, together with the curtain gas from source 24, travel into vacuum chamber 31. Pumps 200, 204, 68, 69 operate to maintain the pressure within chambers at any suitable level, e.g. as described.

Figure 4:
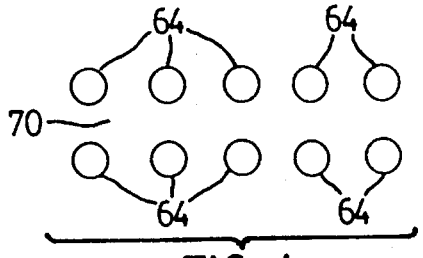
FIG. 4 is a cross-sectional view of an "ion pipe" of the FIG. 1 mass spectrometer.

The rods 64 of ion pipe 60 are, as shown in FIG. 4, simply a set of parallel elongated rods of the kind normally used in quadrupole mass spectrometers, spaced apart to define a volume 70 (FIG. 4) between them. The cross-sectional dimensions of volume 70 correspond to the length and width of slot 50 of rod 32-3. The volume 70 is aligned with slot 50 so that ions ejected through slot 50 will travel through volume 70 to detector 62.

Appropriate AC and DC potentials are applied to the orifice plate 28, the skimmer plate 202, the rods 32 and the rods 64 by a power supply 72, as will be described. Power supply 72 forms part of a controller 74.

The detector 62 may be any suitable detector. For example, it may be a Daly detector. A Daly detector (shown diagrammatically in FIG. 5) is a well-known detector in which ions (here, from ion pipe 60) collide with a stainless steel sheet 80. The collisions produce electrons which impact an aluminum coated plastic scintillator (or phosphor) sheet 82 (the aluminum coating of which is connected to ground or to power supply 72 so that sheet 82 will not charge). Photons emitted as a result of the electron impacts are detected by a photo multiplier tube 84. An advantage of the Daly detector is that it will operate at the relatively high pressures preferred for the equipment 10, namely about $10^{-3}$ Torr. In fact with a sufficiently wide sheet 80, ion pipe 60 can be largely or totally eliminated. Various types of detectors, and transmission devices to them, may be used.

Figure 5:
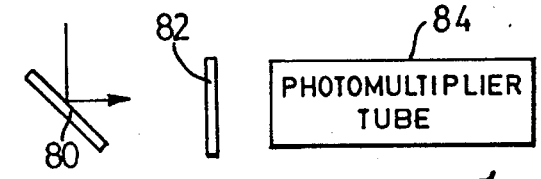
FIG. 5 is a diagrammatic view of a conventional prior art detector for use with the mass spectrometer of the invention.
Figure 5A:
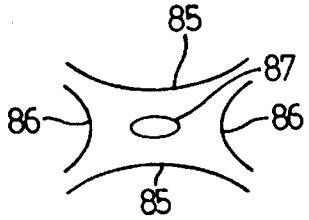
FIG. 5A (PRIOR ART)
FIG. 5A is a diagrammatic cross-sectional view of a conventional ion trap.

In operation, as will be explained, the volume 36 within the rod set 32 will be filled with ions. Because volume 36 is much larger than the volume within a conventional ion trap, volume 36 will hold far more ions than a conventional ion trap. However the most relevant comparison is the number of usable ions which each will store. As indicated in FIG. 5A which shows the end caps 85 and ring electrodes 86 of a conventional ion trap, the ions for good resolution should be collapsed into a small volume 87 centered about the center of the trap. The cross-section of volume 87 is typically an ellipsoid the longer axis of which is 5.0 mm long. Collapsing of the ions into this volume is accomplished, as is well known, by introducing damping gas into the ion trap. This permits the ions to be located in a small volume from which they are then ejected. If the ions were in a larger volume and were located close to the ring electrodes and end caps just prior to ejection, then the ions would pick up energy from the fields on these elements and this would degrade the resolution of the device, "smearing" the peaks in the mass spectrum produced by the device.

Similarly, in order to achieve high resolution it is preferred that ions from ion source 16 not fill the entire volume 36 before the ions are ejected through slot 50. Preferably the ions should also be collapsed into the localized volume, indicated at 88 in FIG. 2. The diameter of volume 88 may also be e.g. 5.0 mm, but since the length of the rod set 32 may typically be more than 20 cm, the length of volume 88 may be (for example) 20 cm or forty times as long as volume 87. Therefore the number of usable ions which rod set 32 will store may be forty times as large as the number of usable ions stored by a conventional ion trap. (These numbers will vary depending on the actual dimensions of the respective devices.)

In typical operation, the apparatus described repeatedly goes through the following cycle:

1. The volume 36 within the rod set 32 is flushed of ions. This may be effected in a number of ways. One such way is to set the radio frequency (RF) voltage applied to the rods 32 to 0 volts, and allowing any ions trapped in the volume 36 to leave. A typical time required for the ions to be flushed is between 1 and 10 milliseconds. The time may be reduced by additional methods, e.g. by maintaining a strong axial field (as described in the co-pending application of Bruce Thomson and Charles Jolliffe entitled "Mass Spectrometer with Axial Field") in one direction while setting the RF voltage on rods 32 to zero or nearly zero, and/or at the same time applying appropriate DC or appropriate dipole fields to the rods to speed up the ejection of all ions.

2. Next, the volume 36 is filled with ions from source 16. The time to fill the volume depends on the size of the volume and on the ion current into it, and also on the efficiency of the device in containing the incoming ion current. By way of example, a typical ion trap will as mentioned usually contain about one million ions before space charge effects become significant. The volume 36 may hold e.g. forty times as many usable ions (as discussed), but since the trapping efficiency of the device in containing ions (in a mass range of interest) directed into it can be about 100% (compared with 3% to 10% efficiency for an ion trap), the time needed to fill the volume 36 with usable ions is not forty times as long as the time needed for an ion trap (assuming the same ion current into both), but may be between one and four times as long. If the source 16 supplies (for example) 100 pico amps or $5\times10^8$ ions per second, then about 80 milliseconds would be required to inject 40 million ions. However the ion source may supply a higher current, so that the fill time can vary between about 1 and 100 milliseconds.

3. After the volume 36 has been filled, a pause time occurs to allow the charge density along the axis 38 become constant. Typically 1 to 10 milliseconds may be allowed for this. It is noted that when the ions enter the volume 36, they are rapidly thermalized as a result of collisions with gas molecules in volume 36, so that they have no net velocity along the axis of rod set 32. While volume 36 has been described as having a pressure of 2 millitorr, this may vary depending on the operation desired; for example the pressure may be increased to 8 millitorr or more.

4. After the pause interval, ions are scanned out of the volume 36. Typically they are scanned sequentially by ramping the RF on rod set 32.

Figure 6:
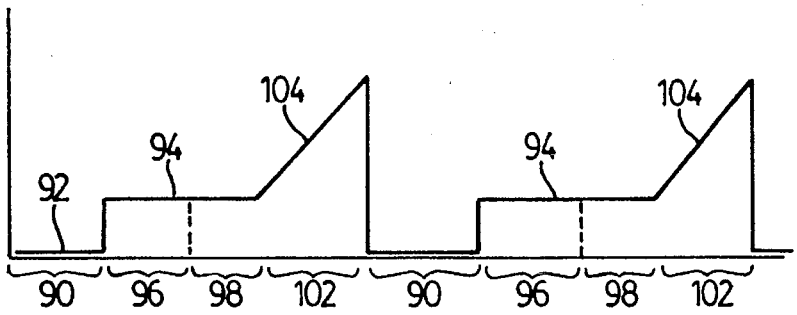
FIG. 6 is a plot showing the amplitude of the radio frequency (RF) potential applied to the rods of the FIG. 1 mass spectrometer.

The amplitude of the RF applied to rod set 32 during this sequence of operations is shown in FIG. 6. As shown during the flush interval 90 the RF amplitude goes approximately to zero, as indicated at 92. The RF amplitude then increases to a preset level as shown at 94 during the fill interval 96, to retain ions in a mass range of interest. During the pause interval 98, the RF amplitude remains constant, at the same level as during the fill interval 96. Then, during the scan interval 102, the RF amplitude is ramped as shown at 104 to eject the ions.

In one example of use of the apparatus described, a potential of 10 volts may be applied to orifice plate 28 and a potential of 0 volts may be applied to skimmer 202. A potential of −5 volts may be applied to entrance lens 40 during filling and a potential of +20 volts (for positive ions) may be applied to lens 40 at times other than fill intervals, to block ions from entering the volume 36. A DC bias of −10 volts may be applied to the rods of rod set 32 (to attract positive ions into volume 36 when the ions are not blocked by entrance lens 40), and a bias of −5 volts DC may be applied to exit lens 44, to block most ions from leaving the volume 36. However if so many ions are injected into volume 36 that space charge effects become significant, the relatively low uphill potential on exit lens 44 will permit some ions to spill out of the volume 36, helping to prevent undue increase of the space charge effects.

Figure 7:
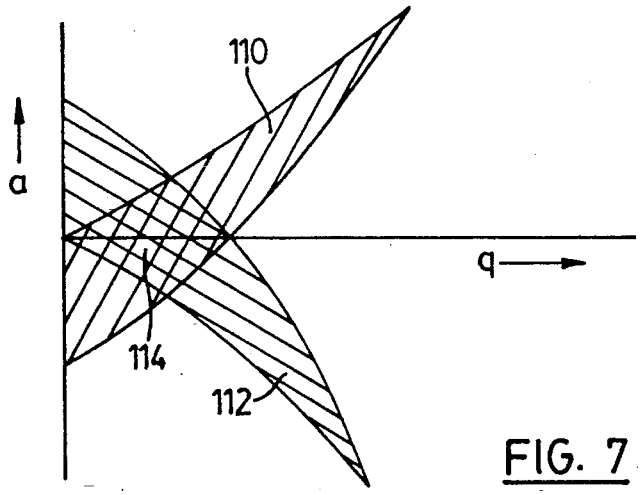
FIG. 7 is a graph showing a two quadrant a/q diagram for ion motion.

The manner in which ions are ejected radially through slot 50 for detection and analysis will next be described, with reference to FIG. 7. FIG. 7 is a two quadrant a/q or Mathieu diagram with the well-known parameters "a" on the vertical axis and "q" on the horizontal axis. Ions having their a and q parameters within shaded area 110 are stable for y-direction motion (the x and y directions are shown in FIG. 2), while ions having their a and q parameters in shaded area 112 are stable for x-direction motion. Ions within overlapping shaded area 114 are stable for both x and y direction motion. The term "stable" is used herein to mean that the ions remain within the volume 36 between the rods and do not have amplitudes of oscillation which would bring them into contact with the x rods 32-1, 32-3 or the y rods 32-2, 32-4 respectively.

Figure 8:
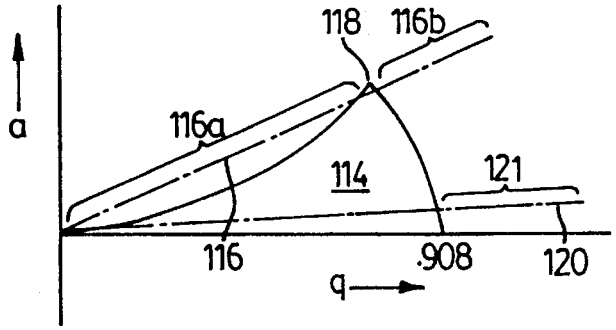
FIG. 8 is a graph showing a conventional single quadrant a/q diagram for ion motion.
Figure 9:
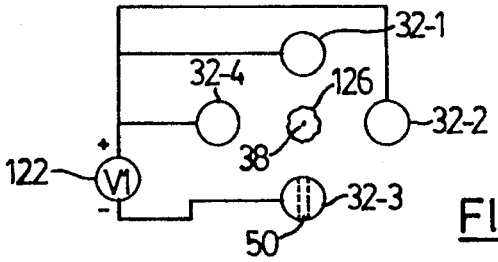
FIG. 9 is a cross-sectional view showing rods of the FIG. 1 mass spectrometer with a DC offset potential applied thereto.

The two quadrant a/q diagram of FIG. 7 is more commonly shown as the single quadrant Mathieu a/q diagram of FIG. 9. When the DC and RF voltages applied between the x and y rods are suitably adjusted, the a/q parameters of the ions may lie on a line 116 (FIG. 8). Ions outside the shaded or stable area 114, on line portion **116*a*, leave in the y direction, while ions on line portion region 116*b* leave in the x direction. In conventional quadrupole mass spectrometry it is normal to operate with the line 116 at the tip 118** of the a/q diagram to eject unwanted ions; the direction of ejection does not matter.

However in the preferred operation of the apparatus described, the operating line 120 may be on the q axis, or it may be near the q axis as shown in FIG. 8. Ions whose a/q parameters are within shaded area 114 are then stable in the y direction while ions whose a/q parameters are on line portion 122 are unstable in the x direction and are ejected toward the x rods 32-1, 32-3. For this purpose, the ratio of DC to RF may typically be between zero and 1.0%, although this can be changed depending on the particular system used, and its application. When operating with a DC to RF ratio greater than zero, ions are ejected toward both x rods 32-1, 32-3, and if only one of these rods has a slot 50 and associated detector 62, then a maximum of only half of the stored ions will be detected. (A similar effect occurs in conventional ion traps.) Thus, ions can be made sequentially unstable by scanning one of the parameters of the RF field (e.g. voltage or frequency) in a known fashion, so that ions are sequentially (one mass-to-charge value after another) ejected toward the rods, some passing through the slot 50 to reach the detector 62, thereby forming a mass spectrum.

As an alternative to applying a DC potential between the x rods and the y rods, an attractive DC potential VI (FIG. 9) from source 122 (which forms part of controller 74) can be applied only to the rod 32-3 containing the slot 50, during the scan mode, to pull ions toward rod 32-3 and through slot 50. The attractive DC voltage applied to rod 32-3 is negative, with reference to all three of the other rods and results in a nonquadrupolar field which nevertheless will have the effect of attracting ions through slot 50.

An alternative method may be used to cause the ions to be preferentially ejected toward one rod, similar to that described in U.S. Pat. No. 5,291,017 for an ion trap mass spectrometer. In this method, a dipole or monopole field is applied between rods 32-2 and 32-3 at the frequency of the RF voltage, but with 2% to 3% of the amplitude of the main RF voltage. If this field is applied to rod 32-2 in phase with the RF, positive ions are ejected toward rod 32-3 preferentially; if applied 180° out of phase, negative ions are ejected toward rod 32-3 preferentially.

Other appropriate methods may be used to eject ions through slot 50, or alternatively otherwise between the rods 32, in a sequential manner so that they can be detected and analyzed. For example the well known resonant ejection method may be used, as described in U.S. Pat. No. 4,540,884 in connection with an ion trap. In the resonant ejection method, the applied RF and DC voltages or the frequency are scanned to sequentially render unstable contained ions of consecutive masses. Resonant ejection of unwanted ions using an auxiliary or dipole RF field was also described in a paper entitled "A Technique for Mass Selective Ion Rejection in a Quadrupole Reaction Chamber" by Watson et al., published in International Journal of Mass Spectrometry and Ion Processes, 93 (1989) 225–235.

As another alternative, the so-called "pump" method may be used, as described in U.S. Pat. No. 5,381,007 also in connection with an ion trap. In the pump method, a supplementary quadrupole field (of different characteristics than the main quadrupole field but of the same spacial form) is applied to the rods 32, typically at double the frequency of the main quadrupolar field and with a smaller amplitude. The combined main quadrupole field and supplementary or pump quadrupole field are scanned to sequentially excite contained ions and to eject them sequentially radially for analysis. (The description and drawings of the above patents and publication are incorporated herein by reference.)

As discussed, the thermalizing effect on the ions due to collisions with gas in volume 36 will compress them into a relatively small volume 88 (FIG. 2) along axis 38. (The ions in effect migrate to positions where the electric forces on them approach zero, and the zero potential line is along axis 38.) To speed up ejection of the ions during the scanning phase, a small dipole AC field may be applied in known manner between two of the rods, e.g. rods 32-1, 32-3, to move the ions off center during the scanning interval.

Figure 10:
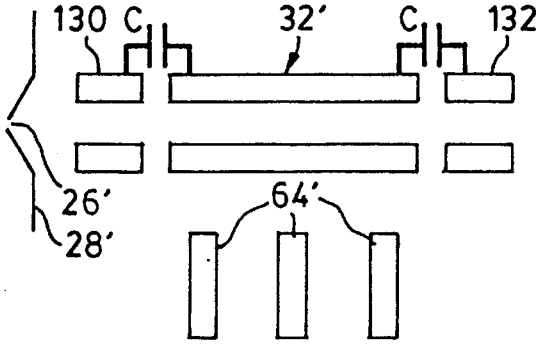
FIG. 10 is a diagrammatic view of a modified mass spectrometer according to the invention.

If desired, and as shown in FIG. 10 where primed reference numerals indicate parts corresponding to those of FIG. 1, small rod sets 130, 132 may be substituted for the end lenses 40, 44. The rod sets 130, 132 receive, through capacitors C, a fraction of the RF voltage applied to the main rods 32. However the DC applied to rod set 132, and to rod set 130 when it is desired to block ions from entering volume 36, will be adjusted to cause rod sets 130, 132 to act in known manner as mirrors, blocking passage of ions while creating little interference with fringing fields from the rod set 32. When rod set 130 is to admit ions into volume 36, the DC on rod set 130 may be set at e.g. −5 volts so that it functions simply as an ion transmission device.

While the embodiments described have shown an external ion source which injects ions into the volume 36 between the rods 32, if desired molecules can be injected into the volume 36 and then ionized by electron impact, chemical ionization, or by other suitable means.

Figure 11:
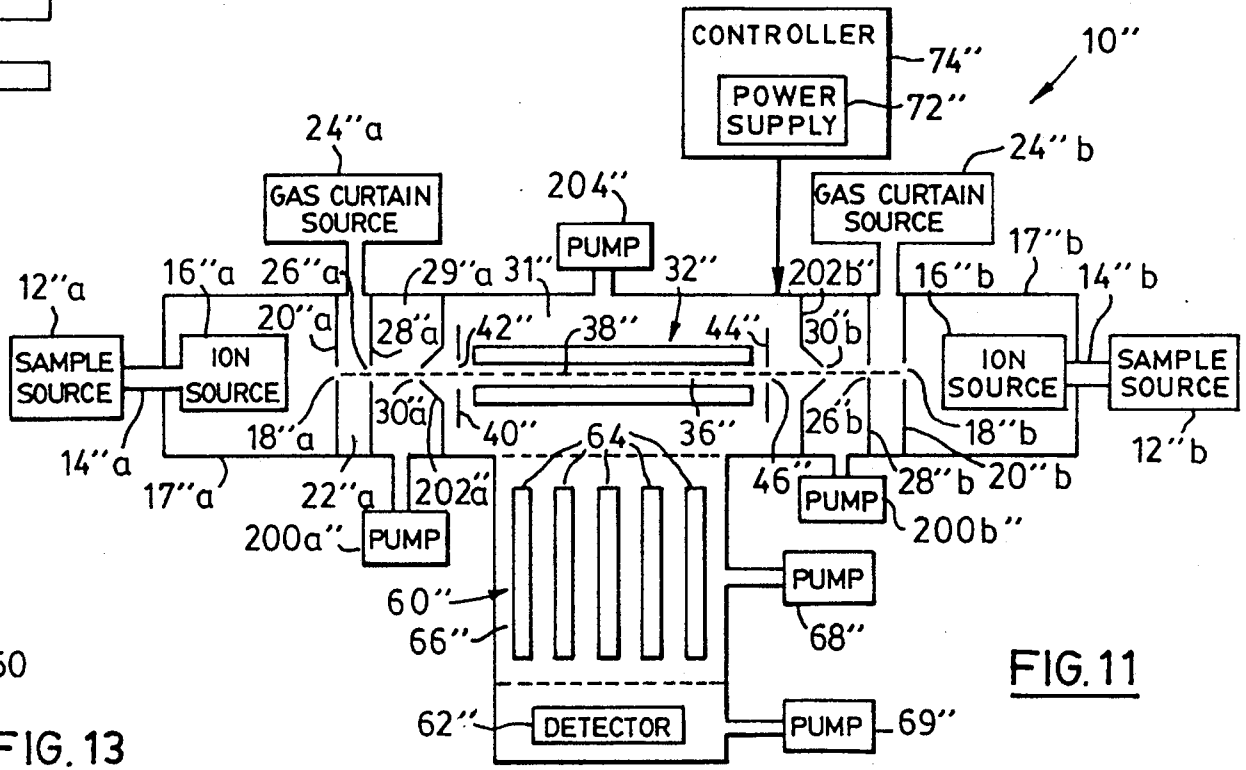
FIG. 11 is a diagrammatic view of a further modified mass spectrometer according to the invention.

While a single ion source has been shown, if desired an ion source can be provided at each end of the rod set 32, as shown in FIG. 11 where double primed reference numerals indicate parts corresponding to those of FIGS. 1 to 5. The FIG. 11 embodiment is the same as that shown in FIG. 1 except that there are now two sample sources **12"*a*, 12"*b* and ion sources 16"*a*, 16"*b*, one at each end of rod set 32". Ions from each ion source may be injected into the volume 36" within the rod set, for analysis. Lens 40" functions as an entrance lens for ion source 16"*a* and as an exit lens when the ions are injected from source 16"*b*. Lens 44" functions as an entrance lens for ion source 16"*b* and as an exit lens for source 16"*a***.

In use, ions from sources **16"*a*, 16"*b* may be admitted in alternating fashion into the volume 36" for processing and analysis (with the entrance and exit lenses controlled by controller 74"). After ions from source 16"*a* have been admitted, scanned out and analyzed, the flush interval 92 will remove all remaining ions from volume 36" so that ions from source 16"*b*** may be admitted and analyzed. While the duty cycle with respect to each ion source is reduced in this embodiment, the embodiment has the advantage that a single analyzer can be operated with two ion sources, effectively simultaneously from the user's viewpoint.

Alternatively, ion source **16"*a* can be used to admit reagent ions which are designed to react with specific molecules which can be admitted from any suitable location into the vacuum chamber containing rod set 32"** (since molecules are being admitted, they need not be admitted through the ion source).

Alternatively, the FIG. 11 arrangement may be operated to admit simultaneously into volume 36" positive ions from source **16"*a* and negative ions from source 16"*b***. The positive ions can for example contain more charges per ion than the negative ions (or vice versa) so that ion-ion reactions may occur to provide three dimensional structure information, or other information.

If it is desired to perform MS/MS in the volume 36, then the sequence of operations would be somewhat different. In a multiple MS operation, all ions except the desired parent ion are first ejected from volume 36, thereby isolating the desired parent ion in volume 36. Several methods may be used to isolate at least one parent ion. In the first method, applied DC and quadrupolar RF voltages may be applied to the rods 32 to position the parent ion in the stable region 114 close to the tip 118 of the a-q stability diagram shown in FIG. 8. The mass width of the stable ion region (which will include the parent ion to be isolated) depends on the width of the portion of the operating line 116 within stable region 114.

In the second method, the RF and DC voltages are set so that the parent ion has a fairly low value of about 0.2 on operating line 120 (which as mentioned may also lie on the q axis). Next, a supplementary AC voltage is applied in dipole fashion between another pair of opposite rods, in order to resonantly eject ions of the next higher mass (i.e. the parent ion mass plus one). The RF voltage is then scanned upward until the parent ion is just inside the stability boundary, and the next lowest mass (i.e. parent ion mass minus one) is just outside the boundary, so that it is ejected. This eliminates all masses except that of the parent from the volume 36.

In the third method of isolating the parent ion, a broad band supplementary AC voltage is applied to the rods 32 as described in connection with FIG. 5 of U.S. Pat. No. 5,179,278. The broad band AC voltage has frequency components corresponding to the resonant frequencies of all ions except the parent ion (i.e. it has a notch at the resonant frequency of the parent ion). The use of such a broad band noise field with a notch at the parent ion mass is also described in U.S. Pat. No. 5,381,007 for application to an ion trap. The notched broad band noise field effectively isolates the parent ion in volume 36. Other methods of using pure and mixed frequency dipolar voltages, together with scanning the RF, have been described for parent ion isolation in an ion trap, and these methods may also be applied to the rods 32.

After all ions but the parent have been removed, the parent ion is dissociated, typically by applying a supplementary AC field to one of the pairs of the rods 32 to excite the parent ions at their resonant frequency, thus producing daughter ions. The RF may then be scanned as described above to eject the daughter ions (or to eject all but daughter ions in a mass range of interest, after which further dissociation and scanning may be performed).

Figure 13:
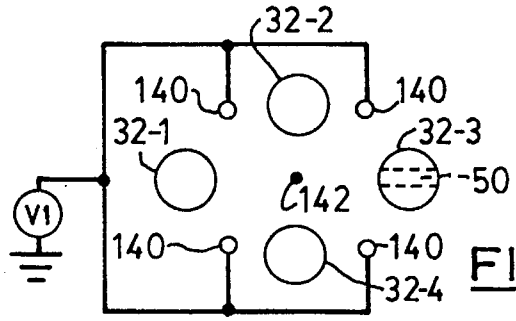
FIG. 13 is an end view of the rods of FIG. 12.
Figure 12:
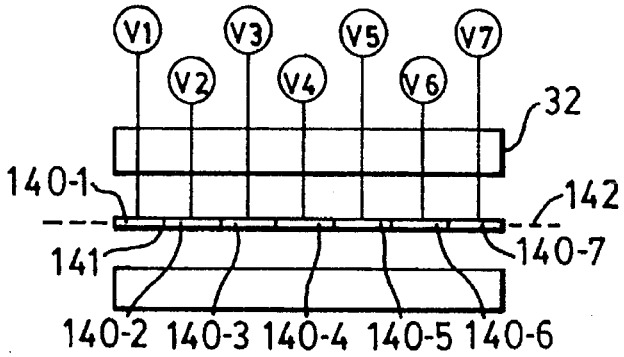
FIG. 12 is a side view of a rod set for the mass spectrometer of FIG. 1 with additional auxiliary rods for creating an axial field.
Figure 14:
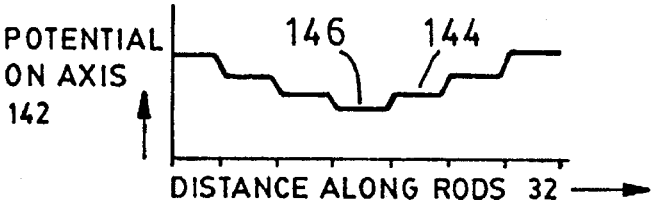
FIG. 14 is a plot showing voltage applied to the auxiliary rods of FIGS. 12 and 13 plotted against distance along the rod set.

Alternatively, if desired, the parent ion can be dissociated by applying an oscillating axial field to the rods 32, in the manner described in the co-pending application of Bruce Thomson and Charles Jolliffe entitled "Mass Spectrometer with Axial Field". The disclosure and drawings of that application are incorporated herein by reference. As described therein, there are numerous ways of establishing an axial DC field along the length of the quadrupole rods. One such method is shown in FIGS. 12 to 14, in which four auxiliary small diameter conductive rods 140 are uniformly positioned between quadrupole rods 32. As will be apparent from FIG. 13, the rods 140 lie on a square rotated at 45° with respect to the square on which rods 32 lie.

Each rod 140 is divided lengthwise into a number of axial segments 140-1 to 140-7, separated by insulators 141. Separate voltages V1 to V7 are applied to each segment by controller 74. The voltages on rods 140 create an axial DC field along the central longitudinal axis 142 of the rod set 32. The profile of the axial DC field will depend on voltages V1 to V7 and can be set and varied as desired. For example when the voltages are higher at the ends of the auxiliary rods 140 and diminish toward the center, the profile may be as shown at 144 in FIG. 14.

The axial DC field may be used for ion dissociation in MS/MS while avoiding certain disadvantages which are present in ion dissociation in a conventional ion trap. Specifically, in a conventional ion trap dissociation is usually achieved by applying a supplementary RF field at relatively low voltage, and at the resonant frequency of the ion to be dissociated. The voltage is sufficiently low so as not to drive the ion out of the trap. The dissociation process is therefore relatively time consuming, since the low voltage applied excites the ion slowly. In addition, if ion fragmentation does not occur, an equilibrium is reached in which the energy input by the supplementary AC voltage is simply dissipated in ion-neutral collisions. For large ions the effect is tantamount to a gradual heating or energy input with a maximum temperature rise. This energy has sufficient time to find the weakest bonds to break, thus producing daughter ions whose spectrum will be different from the usual MS/MS spectrum produced by conventional tandem quadrupole mass spectrometers which can quickly input relatively large amounts of energy. When the weakest bonds break as described, the resulting spectrum often provides little structural information. It is difficult to correct this problem since a higher supplementary voltage will simply drive the ions into or through the ring or cap electrodes of the ion trap.

Where an axial field is provided as shown in FIGS. 12 to 14 and is operated at a high frequency and voltage, the ions can be axially oscillated about their equilibrium positions. It is important not to drive the majority of the ions out the ends of the rod set 32, and therefore the axial field produced may have a potential well as indicated at 146 at its center, and the potential at and adjacent the well 146 will be oscillated to oscillate the ions axially back and forth, e.g. by using controller 74 to vary voltages V3 to V5 inclusive (or indeed all of V1 to V7). Alternatively, since it is preferred to drive the ions hard to dissociate them and therefore it may be preferable not to have a weak axial field at the middle portion of the rod set 32, it may be preferred to have a linear field or even a higher field in the middle portion during dissociation, and to oscillate this field to oscillate the ions axially back and forth, and to control the extent of the ion movements by controlling the amplitude and duration of each half cycle of the field oscillation. While ions near the end of the volume 36 may be lost, ions in the middle portion may be retained in this manner, and dissociated. There is no requirement to operate at the resonant frequency, or even at a harmonic of the resonant frequency; the excitation can for example be a square wave. Without substantial loss, the ions can be axially oscillated about their equilibrium positions by about ±2.5 centimeters, whereas in a conventional ion trap the oscillation amplitude is limited to about ±0.71 cm. Since the maximum energy which can be input to the ions scales as the maximum distance from equilibrium, therefore the energy input to the ions can be substantially greater in the rod set 32 than in a conventional ion trap.

It is also noted that when the axial field is oscillated back and forth, not only parent ions but also daughter ions are excited, so that a richer fragmentation is achieved. Whereas previously in ion trap and quadrupole tandem mass spectrometers, sequential operation was required to obtain $MS^n$, where parent ions are dissociated to form daughter ions, then the daughter ions are dissociated to form further daughter ions, etc., in the present case all of the fragmentation can occur at one time if desired. Since multiple fragmentations (of parent, daughter and subdaughter ions) can all occur at the same time, thus time is saved and the efficiency of operation is increased.

It will be appreciated that other fragmentation methods may be used to dissociate ions in volume 36, e.g. resonant excitation in a radial direction.

The axial oscillation described can be useful not only for fragmenting large ions in MS/MS, but also for dissociating oxide ions in inductively coupled plasma applications (where the ion source is a plasma), and for other ions.

It will be realized that because ions can be transmitted into the rod system described with virtually 100% efficiency (i.e. nearly 100% of the ions in the mass range of interest transmitted into volume 36 will be contained there and not wasted), whereas the corresponding figure for an ion trap is 3% to 10%, therefore the signal to noise ratio of the system described can be ten times or more greater than that of a conventional ion trap.

The dynamic range, or linear dynamic range, is the range over which the response of an instrument (ions per second) remains linear with respect to the amount of injected sample. Since as mentioned the linear quadrupole trap may accommodate forty times as many ions as a conventional ion trap, its dynamic range may be forty times as large (again, these numbers may increase or decrease depending on the ratios of the volumes in which usable ions are contained).

While radial ejection has been disclosed using a conventional quadrupole rod set, if desired other rod configurations may be used, e.g. a hexapole rod set or an octopole rod set. In addition, the fields and geometries can be modified as desired, e.g. as shown in U.S. Pat. No. 4,882,484 (which shows modifications from conventional quadrupole geometry for an ion trap).

Figure 15:
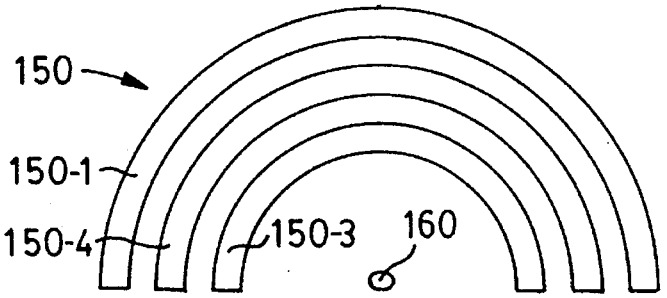
FIG. 15 is a diagrammatic side view of a modified rod set according to the invention.
Figure 16:
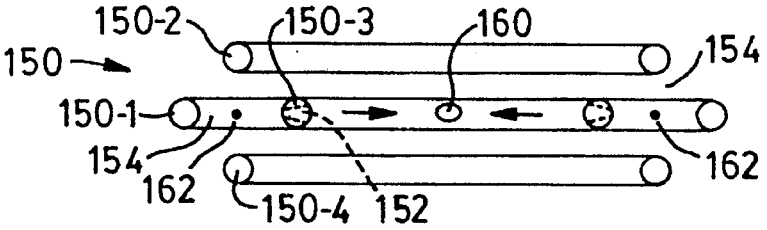
FIG. 16 is a view of the ends of the rods of FIG. 15.

As shown in FIGS. 15 and 16, non linear geometries may be used. FIGS. 15 and 16 show a set of four rods 150-1, 150-2, 150-3, 150-4 which are the same as the rods 32 except that they are arranged in a semi-circular configuration. Rod 150-3 as before contains an elongated slot 152.

The rod set 150 defines an interior volume 154 and may be provided with end lenses or auxiliary rods such as rods 130, 132 of FIG. 10, exactly as previously described. Ions transmitted into volume 154 may be ejected sequentially for detection through slot 152 and are detected at detector 160.

An advantage of the FIGS. 15 and 16 arrangement is that the detector 160 can be small and need not be distributed. Curved hyperbolic rods of the kind shown in FIGS. 15 and 16 are made by Bear Technology of Santa Clara, Calif., U.S.A. for use in conventional mass spectrometers. While the volume 154 is still axially elongated in the FIGS. 15, 16 arrangement, the axis 162 is now of course curved.

While end lenses 40, 44 or supplementary rods 130, 132 have been used for preventing ions from spilling out the ends of the volume 36, alternatively appropriate potentials can be applied at the ends of the rods 32 themselves (particularly where the rods are segmented or where segmented auxiliary rods or a segmented case is used), to create a high enough axial electric field barrier at each end of the volume 36 so that ions cannot spill out the ends of the volume until the space charge therein reaches a predetermined level. The voltages required are applied by the controller 74. Preferably, either when end lenses or auxiliary rods are used, or when potentials are applied at the ends of the rods, the axial field barrier at the ends of volume 36 is adjusted to keep the space charge density at a level where resolution is a maximum. In practice this can be done by checking the resolution and if necessary e.g. lowering the end potentials until the resolution is a maximum (depending of course on the other usual factors), or alternatively raising the field barrier until the resolution begins to degrade.

Figure 17:
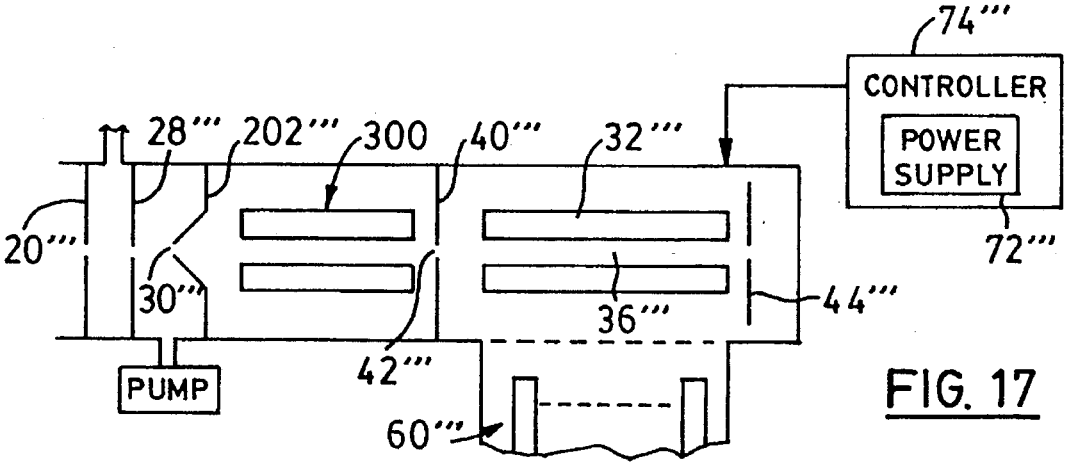
FIG. 17 is a view of rods in a further modified embodiment of the invention.

Reference is next made to FIG. 17, which shows a still further modified embodiment of the invention. In FIG. 17 triple primed reference numerals indicate parts corresponding to those of FIG. 1.

In the FIG. 17 embodiment ions and gas travelling through the skimmer orifice 30''' enters a "high pressure" RF only quadrupole rod set 300. The gas pressure in rod set 300 is sufficiently high (e.g. 8 millitorr) to "cool" the ions (i.e. reduce their kinetic energy) and to provide a low emittance-area beam entering the radial ejection quadrupole rod set 32''' through orifice 42''' in entrance lens 40'''. The ions are contained in rod set 32''' as previously described (by applying appropriate DC and RF potentials to the rods and by applying appropriate potentials to the end lenses 40''', 44''' to inhibit the ions from spilling out the ends), and are then radially ejected through ion pipe 60''' for detection as before.

An advantage of the FIG. 17 arrangement is that there is some evidence that the presence of a damping gas around the ions when they are being sequentially scanned out can adversely affect resolution. With the FIG. 17 embodiment, the main "cooling" of the ions occurs outside the radial ejection rod set, and the ions can then be sequentially radially scanned out of the rod set 32''' for detection without interference from a damping gas. Of course if it were required to perform MS/MS in the radial ejection rod set 32''', then gas would have to be pulsed into volume 36''' to perform the MS/MS, and would then be removed.

While preferred embodiments of the invention have been described, it will be understood that these embodiments are illustrative and various modifications may be made by those skilled in the art.

I claim:

1. A method of mass analyzing a sample comprising the steps of:

(a) defining a volume between a set of elongated rods, said volume having an elongated axial dimension and a pair of ends, and a radial dimension, (b) injecting into or forming ions of interest in said volume, (c) creating an electric field in and adjacent to said volume to contain said ions in a mass range of interest in said volume, establishing an axial field lengthwise along said rods, and oscillating said axial field to dissociate said ions contained in said (d) volume to form the dissociated ions, (e) ejecting at least some of said dissociated ions of interest radially from said volume, for detection, (f) and detecting at least some of the ejected ions.

2. A method according to claim 1 wherein the ions contained in said volume are parent ions, and wherein in said step of oscillating said axial field, said parent ions are dissociated to form daughter ions.

3. A method according to claim 2 further including the step of ejecting said daughter ions sequentially from said volume in order of mass to charge ratio.

4. A method according to claim 2 and including the step of oscillating said axial field to further dissociate said daughter ions to form additional ions, prior to ejecting said ions from said volume.

5. A method of mass analyzing a sample comprising the steps of:

(a) defining a first volume between a first set of elongated rods, said first volume having an elongated axial dimension and a pair of ends, and a radial dimension, (b) producing ions in an ion source outside said first volume, (c) defining a second volume between a second set of rods, said second volume containing a damping gas, (d) transmitting said ions through said damping gas in said second volume, under the influence of an RF field, and into said first volume, to reduce the kinetic energy of said ions from said source before they enter said first volume, said first volume being substantially free of said damping gas, (e) creating an electric field in and adjacent said first volume to contain said ions in a mass range of interest in said first volume, (f) ejecting said ions of interest radially from said first volume, for detection, (g) and detecting at least some of the ejected ions, thus to improve the resolution of said ions ejected from said first volume.

* * * * *